US008573548B2

(12) United States Patent
Kuhn et al.

(10) Patent No.: US 8,573,548 B2
(45) Date of Patent: Nov. 5, 2013

(54) MERCHANDISING SUPPORT SYSTEM

(71) Applicant: Marlite, Inc., Dover, OH (US)

(72) Inventors: Jamie Kuhn, Cambridge, OH (US); Randy A. Breyer, Dover, OH (US); Mary Elizabeth Shea, Louisville, OH (US)

(73) Assignee: Marlite, Inc., Dover, OH (US)

( * ) Notice: Subject to any disclaimer, the term of this patent is extended or adjusted under 35 U.S.C. 154(b) by 0 days.

(21) Appl. No.: 13/661,077

(22) Filed: Oct. 26, 2012

(65) Prior Publication Data

US 2013/0043356 A1 Feb. 21, 2013

Related U.S. Application Data

(63) Continuation of application No. 12/226,548, filed as application No. PCT/US2008/000496 on Jan. 15, 2008, now Pat. No. 8,297,569.

(60) Provisional application No. 61/881,032, filed on Jan. 18, 2007.

(51) Int. Cl.
*A47B 96/06* (2006.01)

(52) U.S. Cl.
USPC ..... 248/220.31; 248/206.5; 248/314; 248/309.4; 248/683; 248/537

(58) Field of Classification Search
USPC ..... 248/205.1, 207, 206.5, 218.4, 220.31, 248/224.7, 251, 314, 520, 523, 534–539, 248/592, 683, 208, 309.4; 403/230, DIG. 1; 211/60.1, 86.01, 87.01, 123, 193, 204
See application file for complete search history.

(56) References Cited

U.S. PATENT DOCUMENTS

| | | | |
|---|---|---|---|
| 1,025,904 | A | 5/1912 | Earhart |
| 2,954,874 | A | 10/1960 | Rouse |
| 3,625,464 | A | 12/1971 | Conran |
| 3,664,617 | A | 5/1972 | Fenwick |
| 5,499,724 | A | 3/1996 | Hickman |
| 5,673,803 | A | 10/1997 | Burback |
| 6,085,916 | A | 7/2000 | Kovacevic |
| 6,203,396 | B1 | 3/2001 | Asmussen |
| 6,481,584 | B1 | 11/2002 | Cantley |
| 7,032,873 | B2 | 4/2006 | Phaneuf |
| 7,424,958 | B1 | 9/2008 | Eley |
| 2006/0231722 | A1 | 10/2006 | Ma |

FOREIGN PATENT DOCUMENTS

| | | | |
|---|---|---|---|
| DE | 9407340 | | 9/1994 |
| DE | 202012003243 | U1 * | 8/2012 |
| EP | 0951851 | | 10/1999 |
| KR | 2009055733 | A * | 6/2009 |
| KR | 2009095684 | A * | 9/2009 |

* cited by examiner

*Primary Examiner* — Terrell McKinnon
*Assistant Examiner* — Eret McNichols
(74) *Attorney, Agent, or Firm* — Wegman, Hessler & Vanderburg

(57) ABSTRACT

Merchandising support system of the type having a holding member adapted for engagement of a cantilevered accessory arm thereto. The holder is adapted for mounting on a surface of a display panel or the like and comprises a mounting platform with a throat extending therethrough. The accessory arm is supported in the throat in cantilevered fashion and includes a first magnetic material that engages a second magnetic material with the latter disposed in the throat proximate to a rear surface thereof.

11 Claims, 4 Drawing Sheets

MERCHANDISING SUPPORT SYSTEM

CROSS-REFERENCE TO RELATED APPLICATION

This application claims the priority benefit of U.S. Provisional Patent Application Ser. No. 60/881,032 filed Jan. 18, 2007. This application is a continuation application and claims the priority benefit of U.S. patent application Ser. No. 12/226,548 filed Oct. 21, 2008.

BACKGROUND OF THE INVENTION

1. Field of Invention

This invention relates to the field merchandising display systems, and more particularly, relates to a merchandising support system mountable on a display panel having a cantilevered accessory arm used to display articles.

2. Description of Related Art

Many types of display systems are used to support merchandise on a display panel or wall at locations such as retail stores. Typically, the display system includes some type of accessory arm such as a peg or bracket that is drilled into the wall or attached in a groove or other opening in the display panel. These display systems are not very functional in that it can be difficult to secure the accessory arm to the display panel, causing the accessory arm to fall out or rotate under the weight of the item being displayed. Alternately, some display systems are too difficult to remove, requiring the use of tools if the display layout is to be changed. Additionally, it is often impossible to use conventional display systems for displaying different products. For example, at times it may be desirable to replace a peg accessory arm with a small shelf or other the type of display.

There has been a tendency to standardize the display systems so that a given bracket may be utilized with multiple types of displays. It would be desirable to have an improved system that can be readily configurable to display different products.

BRIEF DESCRIPTION OF THE DRAWINGS

The structure, operation, and advantages of the presently disclosed embodiment of the invention will become apparent when consideration of the following description taken in conjunction with the accompanying drawings wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
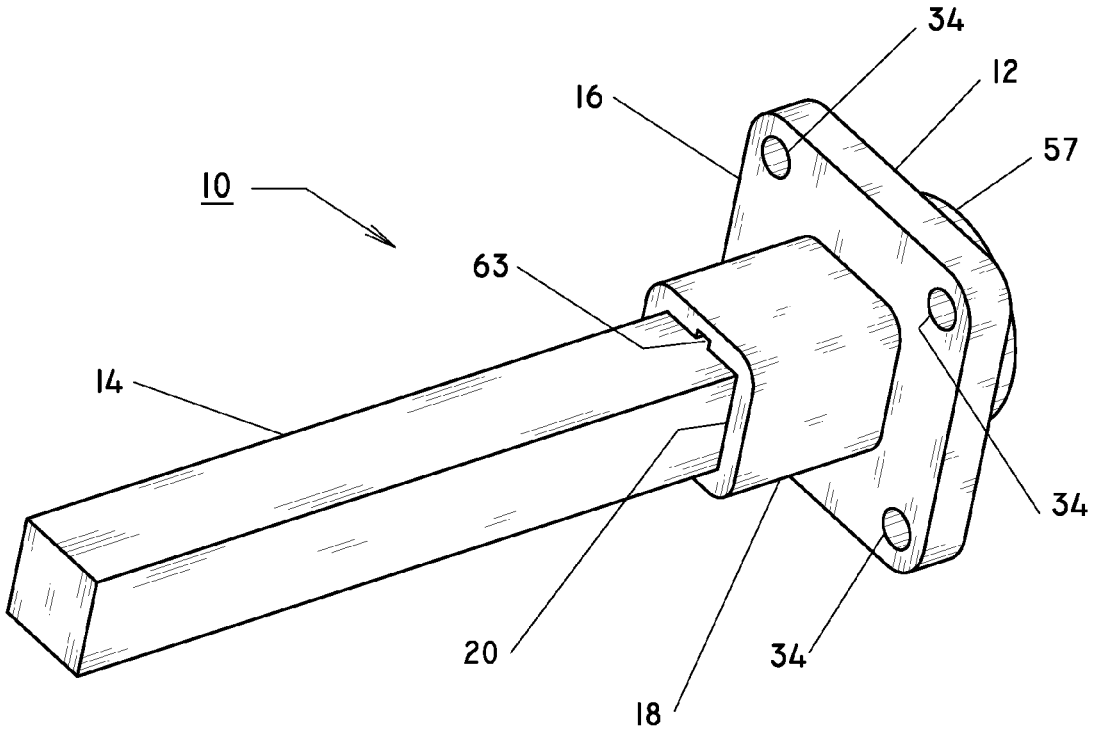
FIG. 1 illustrates a perspective view of a merchandising support system according to one embodiment of the invention.

Referring now to the drawings, FIG. 1 shows a merchandising support system, illustrated generally at 10, used for supporting merchandise on a display panel. The support system 10 includes a holder or base portion 12 and a cantilevered accessory arm 14 mated to the holder 12. The accessory arm 14 may be a bar or a shelf for supporting articles to be displayed. The holder 12 has a keyway 63 and is desirably an injection molded or die cast part having a relatively broad mounting platform or flange 16 and a narrower throat 18 extending from one side of the mounting platform 16. A mouth 20 of the throat 18 is configured to receive one end of the accessory arm 14 as will be discussed in more detail below. The illustrated embodiment shows the throat 18 and accessory arm 14 with a square geometry; however, one skilled in the art will understand that other geometric shapes, such as triangular, hexagonal, and even circular may be used without departing from the scope of the invention. Additionally, the illustrated embodiment is described in conjunction with a vertically disposed display panel. It is clear, however, that the invention may also be used with horizontal or angled display panels.

Figure 2:
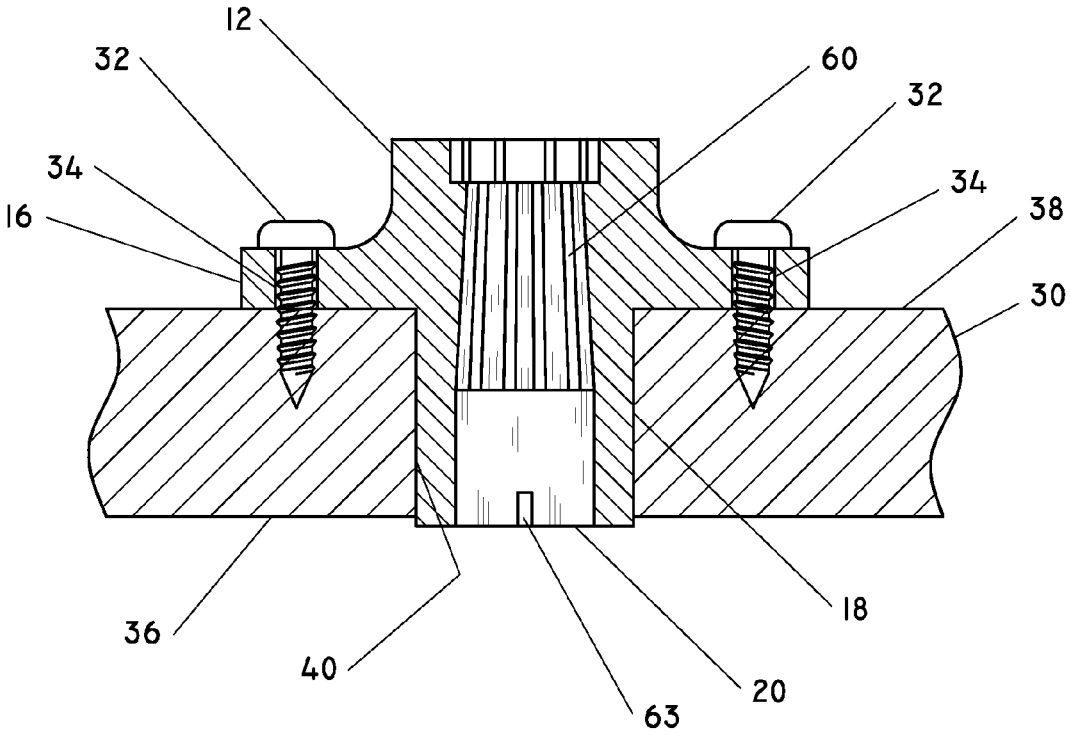
FIG. 2 illustrates section view of a portion of the merchandising support system of FIG. 1 attached to a display panel.

As best seen in the sectional view of FIG. 2, the holder 12 is fastened to a display panel 30 with fasteners 32 that extend through holes 34 located in the mounting platform 16. The panel 30 includes front and back parallel faces 36, 38 and the holder 12 is fastened to the back face 38 with the throat 18 extending through a pocket 40 in the panel such that the mouth 20 of the throat 18 is accessible from the front face 36 of the panel 30. The throat 18 is lined with a female spline 60. The panel 30 may be pre-machined with pockets 40 formed therein as specified by the customer or pockets may be drilled in the panel 30 at the desired locations after the panel is in place.

Figure 3:
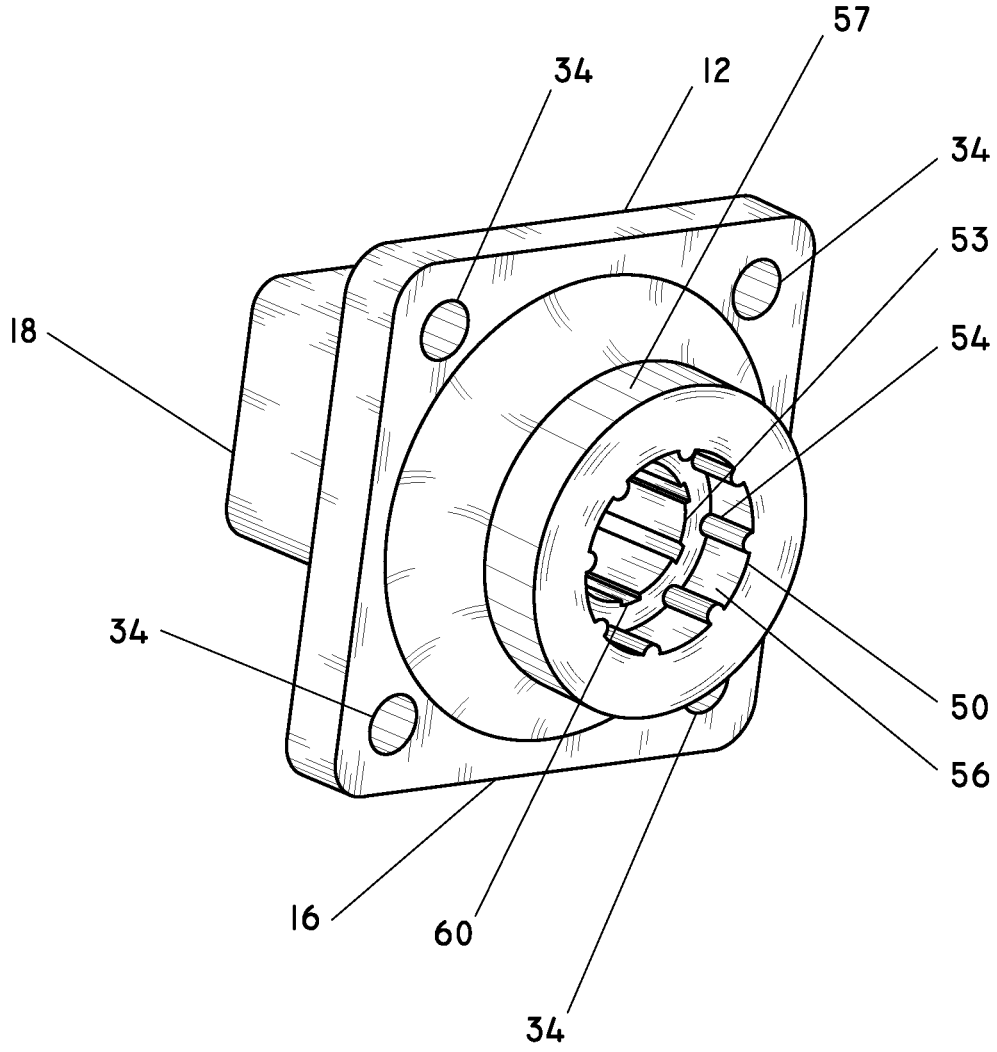
FIG. 3 is a rear perspective view of a portion of the merchandising support system of FIG. 1.
Figure 4:
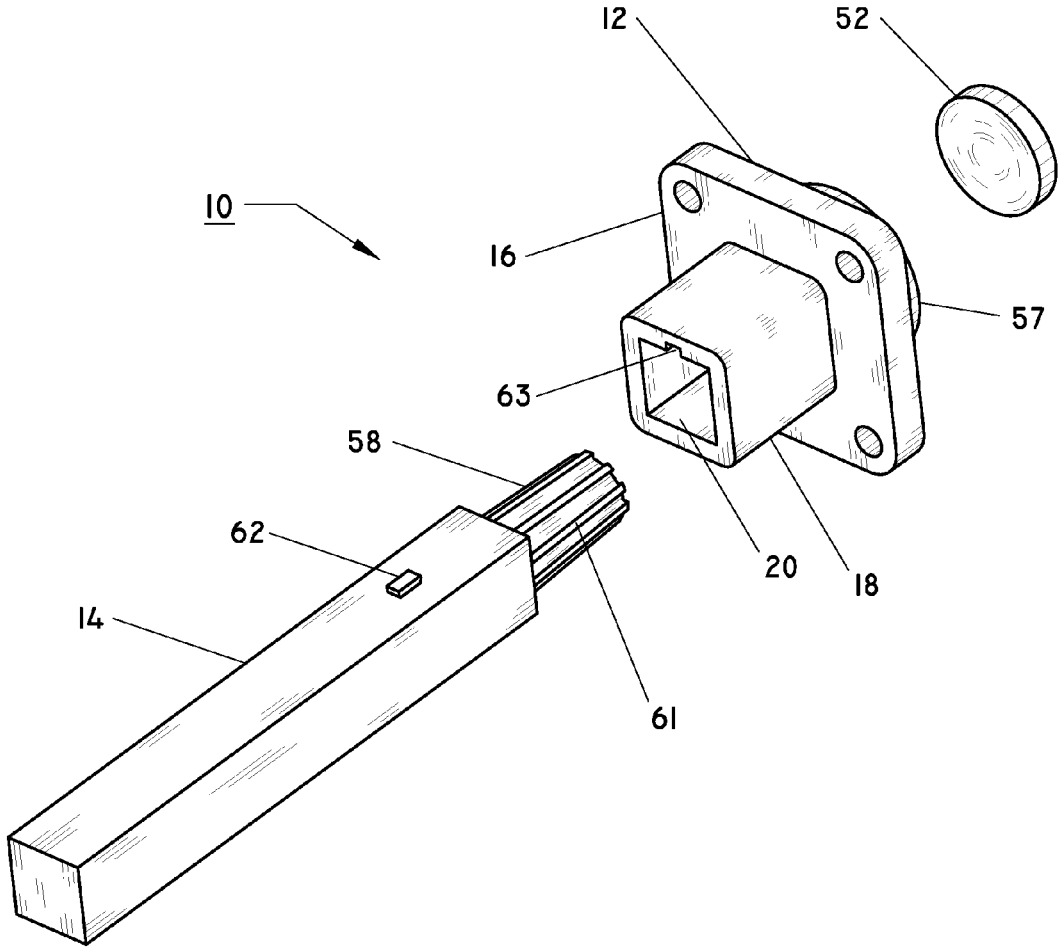
FIG. 4 is an exploded view of the merchandising support system of FIG. 1.

Referring now to FIGS. 3 and 4, the holder 12 has a rear cavity 50 that receives a magnet 52 (FIG. 3). The cavity 50 desirably has an open path to the throat 18 of the holder with the magnet 52 adapted to abut a raised lip 53 to thereby separate the rear cavity from the throat. Alternately, there may be a thin wall between the cavity 50 and the throat 18 that does not substantially impede the magnetic forces of the magnet. Desirably the magnet 52 is received in the cavity 50 by frictional fit; however, one skilled in the art will understand that the magnet may be secured with glue or other fasteners. As best seen in FIG. 3, ridges 54 in a sidewall 56 of the cavity 50 will aid in capturing the magnet 52 by frictional fit. The cavity 50 may be formed by a raised body 57 on the rear end of the holder 12 or may be formed such that it is entirely or partially in the mounting platform 16 of the holder using sound engineering judgment.

A mounting end 58 (FIG. 4) of the accessory arm 14 is composed of a magnetic material that allows the accessory arm 14 to be drawn into the holder 12 via the magnetic force exhibited by the magnet 52 located in back of the holder 12 and helps secure the accessory arm 14 in the holder 12 such that the accessory arm 14 is held in place by a combination of taper lock or snap fit of the accessory arm in the throat 18 and the magnetic force. The tapering contour of the throat may be best viewed in FIG. 2. It also can be appreciated that the accessory arm 14 may be quickly and easily removed from the display panel 30 simply by pulling on the accessory arm 14 to remove it from the holder 12 without the need for tools or access to the back face of the panel 30. The accessory arm 14 and throat 18 are desirably shaped such that mating surfaces between these components are keyed and splined to prevent rotation of the accessory arm 14 in the throat 18. The mounting end 58 of the accessory arm 14 has a male spline 61 that corresponds with the female spline 60 of the throat 18. The accessory arm 14 has a key 62 that corresponds with the keyway 63 in the holder 12. Accordingly, the holder 12 engages the accessory arm 14 with a fit that minimizes movement and rotation of the accessory arm with respect to the display panel 30.

The illustrated accessory arm 14 is a simple peg on which merchandise may be displayed. However, with the present invention, it is to be appreciated that the display system 10 may be easily reconfigured with several different types of accessory arms 14. For example, the illustrated peg type accessory arm 14 may be replaced with an accessory arm comprising a small shelf or table frame or with any desired shape of accessory arm depending on the type of merchandise to be displayed. In order to switch the type of accessory arm 14 being used in the system 10, one must only remove the current accessory arm 14 from the holder 12 and replace it with a different accessory arm.

Accordingly, in one embodiment of the invention, a merchandising support system is provided to support merchandise on a display panel wherein a holder of the system is adapted for secure engagement to the display panel. A mounting platform is provided on the holder and has a throat extending through the platform from a forward surface of the platform to a rear surface of same. An accessory arm is cantileveringly supported in the throat and includes a first magnetic material adapted for magnetic attraction to a second magnetic material which second magnetic material is attached to the mounting platform proximate the throat.

Additionally, the throat, as it extends from the front surface toward the rear surface of the mounting platform, may be tapered. Further, a lip member may be disposed in the throat proximate the rear surface and acts as a shoulder or the like for mounting of the second magnetic material in abutment therewith.

The second magnetic material may, for example, be in the shape of a magnetic disc which is seated along the lip member. Additionally, the sidewall surrounding the throat may include ribs or the like adapted for firm engagement with the second magnetic material so as to form a friction fit of the second magnetic material in the throat. In one exemplary embodiment, the lip is located in the throat intermediate the front surface of the mounting platform and the ribs. Additionally, in accordance with another embodiment of the invention, the attachment arm and the throat can include engaging surface portions thereof that are keyed/splined so as to enhance mechanical interlocking of the attachment arm in the throat.

The mechanical support system is adapted for use in conjunction with a display panel of any particular geometric disposition, although a vertical disposition is exemplified in the instant disclosure. The display panel itself can comprise an aperture or bore therein adapted for communication with the throat of the merchandising support system adjacent the rear surface of the mounting platform.

The holder itself may be formed from a variety of materials such as metals and plastics and may be injection molded or die cast.

Although the use of ridges and associated lip member are shown in the drawings to secure the magnet in the rear portion of the throat, the magnet could readily be affixed in the throat via glue or other fastening means.

The accessory arm may itself be a shelf, bar, or peg or other geometric structure.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A merchandising support system used for supporting merchandise on a display panel, the system comprising:

a holder adapted for secure attachment to said display panel, wherein said holder is formed of a mounting platform, said mounting platform having a throat extending from a forward surface of said mounting platform toward a rear surface of said mounting platform, said mounting platform also having a cavity extending from said rear surface of said mounting platform toward said forward surface, wherein said throat and said cavity form a continuous pathway through said mounting platform, and said mounting platform having a lip separating said throat from said cavity, said holder having a rear side having an opening in communication with said cavity;

an accessory arm cantileveringly supported in said throat and including a first magnetic material; and a second magnetic material disposed within said cavity of said mounting platform adjacent to said lip to magnetically attract said first magnetic material to support said accessory arm in said throat.

2. The merchandising support system as recited in claim 1 wherein said throat is tapered from said front surface toward said rear surface.

3. The merchandising support system as recited in claim 1, wherein said second magnetic material being disposed in said throat in abutment with said lip.

4. The merchandising support system as recited in claim 3 wherein said throat comprises a surrounding sidewall with a plurality of ridges formed along said sidewall.

5. The merchandising support system as recited in claim 2 wherein said accessory arm and said throat including engaging surfaces that are keyed together.

6. A merchandising support system used for supporting merchandise on a display panel, the system comprising:

a holder adapted for secure attachment to said display panel, said holder including a throat formed continuously through said holder, said throat having a forward portion extending from a forward surface of said holder and a rear portion extending from a rear surface of said holder and a lip is formed between the forward portion and the rear portion to separate said forward portion from said rear portion, and wherein said forward portion of said throat includes a keyway formed therein, said rear surface having an opening in communication with said rear portion;

an accessory arm supportable within said forward portion of said throat, wherein said accessory arm includes a key extending outwardly for engagement with said keyway to prevent rotation of said accessory arm relative to said holder; and a magnet located in said rear portion of said throat and abutting said lip, said magnet being attractable to said accessory arm for magnetically securing said accessory arm in said forward portion of said throat.

7. The merchandising support system of claim 5, wherein said forward portion of said throat is tapered.

8. The merchandising support system of claim 5 further includes a plurality of ridges formed along a sidewall of said forward portion of said throat, said plurality of ridges engageable with a corresponding plurality of grooves formed into said accessory arm.

9. A merchandising support system used for supporting merchandise on a display panel, the system comprising:

a holder attachable to said display panel, said holder including a forward surface and a rear surface;

a throat formed through at least a portion of said holder, said throat extending from said forward surface of said holder;

a cavity formed through at least a portion of said holder, said cavity extending from said rear surface of said holder, wherein said throat and said cavity are connected to form a continuous pathway through said holder, wherein said rear surface has an opening in communication with said cavity;

a magnet located in said cavity, said magnet positioned in an abutting manner against a lip separating said throat and said cavity; and an accessory arm supportable within said throat, said magnet within said cavity being attractable to said accessory arm for magnetically securing said accessory within said throat.

10. The merchandising support system of claim 9 further comprising a female spline lining said at least a portion of said throat and a corresponding male spline lining a portion of said accessory arm, wherein said male splines are received in said female splines when said accessory arm is positioned within said throat.

11. The merchandising support system of claim 9, wherein at least a portion of said throat is tapered with respect to a direction extending from said front surface toward said rear surface.

* * * * *

UNITED STATES PATENT AND TRADEMARK OFFICE

CERTIFICATE OF CORRECTION

PATENT NO. : 8,573,548 B2
APPLICATION NO. : 13/661077
DATED : November 5, 2013
INVENTOR(S) : Jamie Kuhn, Randy A. Breyer and Mary Elizabeth Shea It is certified that error appears in the above-identified patent and that said Letters Patent is hereby corrected as shown below:

In the Claims:

In column 4, line 66, in Claim 7, delete "5," and insert -- 6, --, therefor.

In column 5, line 1, in Claim 8, delete "5" and insert -- 6 --, therefor.

Signed and Sealed this
Sixth Day of May, 2014

Michelle K. Lee

Michelle K. Lee
*Deputy Director of the United States Patent and Trademark Office*